United States Patent [19]

Matsumoto et al.

[11] Patent Number: 4,516,133

[45] Date of Patent: May 7, 1985

[54] ANTENNA ELEMENT HAVING NON-FEED CONDUCTIVE LOOP SURROUNDING RADIATING ELEMENT

[75] Inventors: Shigeru Matsumoto; Yoshikatsu Okabe; Yasuhiro Kazama, all of Mitaka, Japan

[73] Assignee: Japan Radio Company, Limited, Tokyo, Japan

[21] Appl. No.: 415,343

[22] Filed: Sep. 7, 1982

[30] Foreign Application Priority Data

Sep. 9, 1981 [JP] Japan ..... 56-141831

[51] Int. Cl.[3] ..... H01Q 1/52; H01Q 19/19

[52] U.S. Cl. ..... 343/819; 343/840; 343/841

[58] Field of Search ..... 343/890, 833, 834, 835, 343/836, 837, 838, 841, 819, 840

[56] References Cited

U.S. PATENT DOCUMENTS

| | | | |
|---|---|---|---|
| 2,556,046 | 6/1951 | Simpson | 343/833 |
| 2,657,313 | 10/1953 | Antony | 343/890 |
| 2,998,605 | 8/1961 | Orlando | 343/829 |
| 3,605,104 | 9/1971 | Weston et al. | 343/837 |
| 3,887,926 | 6/1975 | Schwartz et al. | 343/837 |
| 4,240,080 | 12/1980 | Woodward | 343/817 |

FOREIGN PATENT DOCUMENTS

| | | |
|---|---|---|
| 959019 | 5/1964 | United Kingdom . |
| 1396827 | 6/1975 | United Kingdom . |
| 1555307 | 11/1979 | United Kingdom . |

OTHER PUBLICATIONS

"Dipole-Disk Antenna with Beam-Forming Ring" By Per-Simon Kildal and Svein A. Skyttemyr, pp. 529-531, of IEEE Transactions on Antennas and Propagation, vol. AP-30, No. 4, Jul. 1982.

*Primary Examiner*—Eli Lieberman
*Assistant Examiner*—K. Ohralik
*Attorney, Agent, or Firm*—Frishauf, Holtz, Goodman & Woodward

[57] ABSTRACT

The directivity as well as the gain of an antenna element associated with a finite length reflector, which includes a feed antenna such as a dipole antenna and a reflector having a finite length of several wavelengths or less, are improved by disposing a non-feed loop element having a peripheral length of about 2 wavelengths along a common imaginary plane with the feed antenna so as to surround the feed antenna. Preferably, the non-feed loop element is disposed in parallel to the reflector, and more preferably it is disposed nearly symmetrically with respect to the center of the feed antenna.

7 Claims, 6 Drawing Figures

ANTENNA ELEMENT HAVING NON-FEED CONDUCTIVE LOOP SURROUNDING RADIATING ELEMENT

BACKGROUND OF THE INVENTION

The present invention relates to improvements in directivity and gain of an antenna element associated with a finite length reflector, which has wide-angle directivity.

Explaining now, by way of example, in connection with an antenna element associated with a finite length reflector in which a feed antenna consists of a ½ wavelength dipole antenna (i.e. a dipole antenna associated with a reflector), in the case where the area of the reflector is small as compared to a square of an operating wavelength (λ), the effect of the reflector is not fully achieved, resulting in degradation of the directivity and lowering of the gain. Especially with respect to the H-plane (a plane of magnetic field) directivity, degradation of the directivity in the proximity of the directions of extension of the reflector, that is, in the proximity of ±90° relative to the direction of the maximum direction is remarkable, and radiation power of −6 to −10 dB relative to the maximum value of radiation has been observed. Accordingly, in the event that this antenna element is used, for example, as an element in an array or as a primary radiator of a parabolic reflector antenna, large sidelobes would be generated in the proximity of the above-described directions, and it becomes a cause for degradation of a performance of the directional antenna.

An antenna element associated with a rimmed reflector which has been heretofore used to obviate the above-mentioned shortcoming is schematically illustrated in FIG. 1, in which are shown a reflector 101, a metallic rim 102 electrically connected to the reflector 101, a dipole antenna 103 serving as a feed antenna and a feeder 104.

In the illustrated case, in order to improve the directivity it is necessary to select appropriately the respective dimensions of a diameter (d) of the reflector 101, a length (l) of the metallic rim and a gap distance (s) between the reflector 101 and the dipole antenna 103. However, at present a design procedure for uniquely determining these dimensions is not clearly known, but they are empirically determined in practice, and so, the above-mentioned structure is inconvenient for use. Furthermore, there exists a problem with respect to increase of weight and manufacture resulting from the provision of the metallic rim 102.

Alternatively, an antenna element in which a dipole antenna 103 is disposed within a circular waveguide 110 as shown in FIG. 2, has been also known in the prior art. In this case, when a diameter ($d_1$) of the circular waveguide 110 is one wavelength or less (i.e. when the antenna aperture is small), a high frequency current is made to flow along the inside wall surface of the circular waveguide 110 towards the antenna aperture by an electromagnetic wave excited by the dipole antenna 103, and because of the small antenna aperture, a current ($I_O$) flowing from the inside wall surface of the circular waveguide 110 to its outside wall surface is generated at the antenna aperture. This current ($I_O$) would flow inversely towards the reflector 101 and at the same time would radiate an electromagnetic wave, resulting in degradation of the directivity. Accordingly, an antenna element having the above-mentioned structure necessitates the additional provision of a countermeasure such as a Bazooka balun for preventing current from outflowing to an outside conductor of the circular waveguide 110, and hence the antenna element has the shortcoming that complexity in structure as well as increase of weight accompanying the provision of the circular waveguide, are brought about.

SUMMARY OF THE INVENTION

It is therefore a principal object of the present invention to provide an improved antenna element that is free from the above-mentioned shortcomings in the prior art.

A more specific object of the present invention is to provide an antenna element in which directivity as well as gain are greatly improved with a simple construction.

According to one feature of the present invention, there is provided an antenna element associated with a finite length reflector which includes a feed antenna such as a dipole antenna or the like, and a reflector having a finite length of several wavelengths or less disposed in association with the feed antenna, in which a non-feed loop element having a peripheral length of about 2 wavelengths is disposed within an imaginary plane containing the feed antenna so as to surround the feed antenna.

According to another feature of the present invention, in the above-featured antenna element, the non-feed loop element consists of a metallic conductor disposed in parallel to the reflector and nearly symmetrically with respect to the center of the feed antenna.

The above-mentioned and other features and advantages of the present invention will become more apparent by reference to the following description of preferred embodiments of the invention taken in conjunction with the accompanying drawings.

DETAILED DESCRIPTION OF PREFERRED EMBODIMENTS

Figure 1:
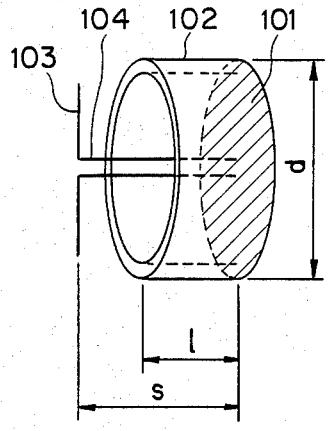
Fig. 1 (PRIOR ART)
FIG. 1 shows an antenna element associated with a rimmed reflector in the prior art.
Figure 2:
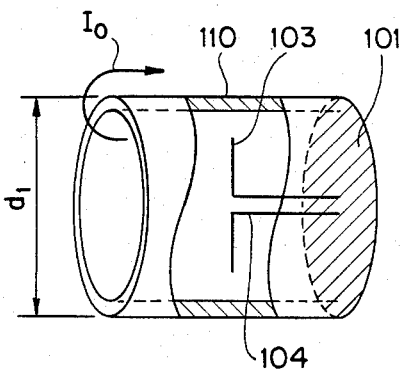
Fig. 2 (PRIOR ART)
FIG. 2 shows an antenna element associated with a circular waveguide in the prior art.
Figure 3:
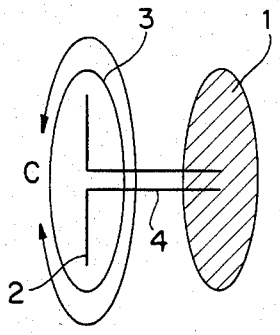
FIG. 3 is a schematic view showing an antenna element according to the present invention.

An antenna element constructed according to one preferred embodiment of the present invention is illustrated in FIG. 3 which shows a reflector 1, a dipole antenna 2 serving as a feed antenna, a non-feed loop 3 having a peripheral length (C) equal to about 2 wavelengths and a feeder 4. In this construction, non-feed loop 3 is parallel to reflector 1 having a finite length of several wavelengths or less, and it defines a common imaginary plane with feed antenna 2 and is disposed symmetrically with respect to the center of feed antenna 2.

Representing the operating wavelength by λ, as the peripheral length (C) of non-feed loop 3 is $C \cong 2\lambda$ the diameter of non-feed loop 3 has a dimension of about $0.6\lambda \sim 0.7\lambda$. On the other hand, the dimension of a $\frac{1}{2}$-wavelength antenna forming feed antenna 2 is $0.5\lambda$ and the diameter of reflector 1 has a dimension between 0.5 wavelengths and several wavelengths in order to have the effect of a reflector. Accordingly, the dimension of non-feed loop 3 is small so that it is nearly equal to that of feed antenna 2. Moreover, since it is wire-shaped, it is light in weight. In this arrangement, one can consider that excitation sources are present at two points A and B on the circumference of non-feed loop 3 which are symmetrical with respect to the center of feed antenna 2 as shown in FIG. 4, and hence, the amplitudes and phases of excitation at the respective points by feed antenna 2 are equal to one another.

In the above-described construction of the antenna element, at first analysis will be made on the E-plane (a plane of electric field) directivity. The diameter of non-feed loop 3 is $0.6\lambda \sim 0.7\lambda$ and is longer than the length of feed antenna 2. Owing to the fact that non-feed loop 3 has a circular shape, however, one can consider that any E-plane component radiated from the portion of non-feed loop 3 in the regions exceeding the length of the $\frac{1}{2}$-wavelength dipole, i.e., the circumferentially opposed regions of the loop 3 which lie nearest the outer ends of the feed dipole antenna 2, is almost not present. Therefore, the electrical dimension of the aperture is substantially determined by the dimension of feed antenna 2, so that the E-plane directivity is not influenced at all by non-feed loop 3.

Figure 4:
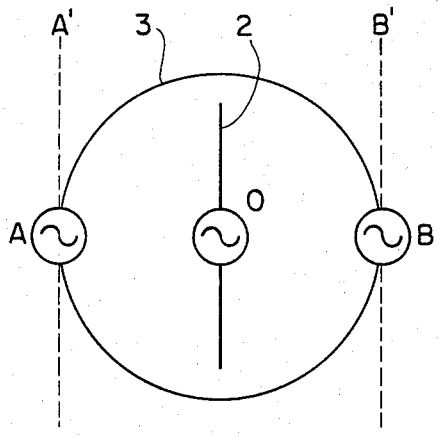
FIG. 4 is a diagrammatic view to be used for explaining the operation principle of the present invention.

Now considering the H-plane (a plane of magnetic field) directivity, the antenna element is deemed as if $\frac{1}{2}$-wavelength dipole antennae are excited at the points A and B in FIG. 4 with the same amplitudes and the same phases, as described previously. Therefore, the antenna element is equivalent to one having a three-element array consisting of imaginary antenna A′, feed antenna 2 and imaginary antenna B′ as shown in FIG. 4. In addition, since the immaginary antennae A′ and B′ are connected by loop 3, a load is automatically applied between them. Therefore, the excitation phases at the points A and B are made close to the phase of the feed antenna 2, and moreover the excitation amplitudes are made small. Accordingly, the H-plane directivity provided by the three-element array is such that the radiated electric power in the directions of extension of reflector 1 is reduced to $-20$ to $-25$ dB and at the same time an increase of a gain of about 1 dB is resulted from the broadening of the aperture dimension.

It is to be noted that in the case where antenna elements according to the present invention are arrayed in large numbers, it is possible to reduce mutual coupling as compared to the array of antenna elements in the prior art because of the fact that the electric power in the directions of extension of the reflector 1 in the H-plane is small, and therefore, the above-mentioned antenna element is effective as antenna elements to be used in antenna arrays. In addition, non-feed loop 3 essentially has a wideband characteristic, and so, the above-mentioned structure of an antenna element is well applicable also to a wideband feed antenna. In other words, this leads to the fact that the antenna element operates well even if the peripheral length (C) of non-feed loop 3 is in a range of $1.5\lambda \lesssim C \lesssim 2.5\lambda$. This introduces an advantage of facilitating manufacture of the loop. Furthermore, a merit of the antenna element exists also in that a sufficient effect can be achieved even if a gap between non-feed loop 3 and reflector 1 falls in a range of about $\frac{1}{8}$ wavelengths to $\frac{3}{8}$ wavelengths.

Figure 5:
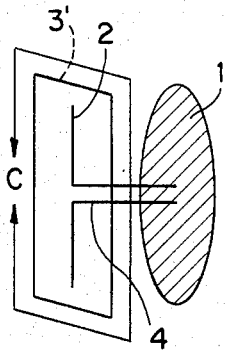
FIG. 5 is a schematic view of another embodiment.

With regard to the shape of the non-feed loop, not only a circular shape but also a square shape could be employed. A square-shape loop 3′ is shown in FIG. 5. Moreover, the non-feed loop could be formed of a ring-shaped member stamped from a sheet material, and further, it could be of a structure printed or disposed on an appropriate dielectric body which also serves as a support for the loop.

Figure 6:
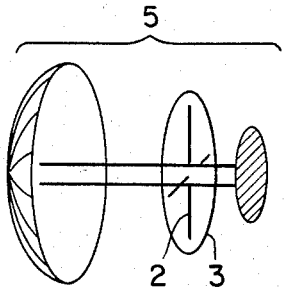
FIG. 6 is a schematic perspective view of an application of the present invention to a primary radiator in a parabolic antenna.

Referring to FIG. 6, in an application of the above-described antenna element, a circularly polarized wave antenna (crossed-dipole antenna) is used as a feed antenna 2 and the antenna element associated with a reflector is employed as a primary radiator in a parabolic antenna. This is a practical example proving the fact that the proposed antenna element can effectively operate even in the case of a circularly polarized wave because of the fact that non-feed loop 3 is made of a closed conductor. In this case, as compared to the case where non-feed loop 3 is not used, suppression of sidelobes of the order of $-10$ dB can be achieved in the directions of $\pm 70° \sim 110°$ with respect to the direction of the maximum radiation, and an improvement in the directivity can be realized up to an electric power level of $-30$ dB or less relative to the maximum radiation power. The gain in the direction of the maximum radiation also rose by $0.7 \sim 1.0$ dB, and an effect in the case of a linearly polarized wave has been confirmed.

In the above-described construction of the antenna element, by merely mounting a non-feed loop that is simple in manufacture in operative relation to an antenna element associated with a reflector, not only the above-mentioned improvements in directivity and gain, but also the following advantages are obtained. That is, since the non-feed loop is not interrupted on its circumference, the above-mentioned structure is applicable to an antenna element associated with a reflector which radiates not only a linearly polarized wave but also any polarized wave such as a circularly polarized wave, and moreover it has a wideband characteristic. In addition, the directivity of the antenna element can be varied by making the non-feed loop eccentric with respect to the feed antenna or by disposing the non-feed loop as inclined with respect to the reflector instead of in parallel to the reflector. Therefore, there is an advantage that the variation of the directivity can be utilized for improving asymmetry of the directivity caused, for example, by unbalanced excitation of the feed antenna in relation to the use of a linearly polarized wave. Also, in connection with a circularly polarized wave, there is an advantage that the variation of the directivity can be utilized for improvements in a circular polarization ratio (axis ratio). Furthermore, it is also effective for eliminating or reducing mutual coupling in an antenna array as described previously.

What is claimed is:

1. An antenna element adaptable for use as a primary antenna in a parabolic antenna system, comprising a feed dipole antenna, a reflector having a finite length and supported in spaced-apart operative relation to said feed dipole antenna, and a non-feed loop element stationarily disposed around said dipole antenna generally in parallel with said reflector and electrically insulated from both said dipole antenna and said reflector, said non-feed loop element being a closed and endless loop element of a wire-like thin conductor material in the plane of said dipole antenna, wherein said non-feed loop element is of a shape and circumferential length selected to increase the H-plane directivity of said feed dipole antenna and said reflector in the absence of said non-feed loop element, in the proximity of the directions of extension of said reflector.

2. An antenna element as claimed in claim 1, wherein said dipole antenna has a length of ½ wavelengths, and the entire circumference of said non-feed loop element has a length of 1.5λ–2.5λ.

3. An antenna element as claimed in claim 1, wherein said non-feed element is formed in a circular ring shape.

4. An antenna element as claimed in claim 1, wherein said non-feed loop element is formed in a square shape.

5. An antenna element as claimed in claim 1, wherein said non-feed loop element is disposed substantially symmetrically with respect to the center of said feed antenna.

6. An antenna element as claimed in claim 2, wherein said non-feed looop element is formed in a circular ring shape of a diameter of 0.6λ–0.7λ.

7. An antenna element as claimed in claim 1, wherein said dipole antenna is a cross dipole antenna.

* * * * *